US008190426B2

(12) United States Patent
Krini et al.

(10) Patent No.: US 8,190,426 B2
(45) Date of Patent: May 29, 2012

(54) SPECTRAL REFINEMENT SYSTEM

(75) Inventors: Mohamed Krini, Ulm (DE); Gerhard Uwe Schmidt, Ulm (DE)

(73) Assignee: Nuance Communications, Inc., Burlington, MA (US)

( * ) Notice: Subject to any disclaimer, the term of this patent is extended or adjusted under 35 U.S.C. 154(b) by 1201 days.

(21) Appl. No.: 11/948,137

(22) Filed: Nov. 30, 2007

(65) Prior Publication Data

US 2008/0195382 A1 Aug. 14, 2008

(30) Foreign Application Priority Data

Dec. 1, 2006 (EP) ..... 06024940

(51) Int. Cl.
*G10L 19/02* (2006.01)

(52) U.S. Cl. ..... 704/203; 704/269

(58) Field of Classification Search ..... 704/203, 704/269

See application file for complete search history.

(56) References Cited

U.S. PATENT DOCUMENTS 5,484,391 A * 1/1996 Buckman et al. ..... 601/135
5,504,833 A * 4/1996 George et al. ..... 704/211
5,699,404 A * 12/1997 Satyamurti et al. ..... 340/7.28
5,890,108 A * 3/1999 Yeldener ..... 704/208
6,377,916 B1 * 4/2002 Hardwick ..... 704/208
6,947,509 B1 9/2005 Wong
2004/0125878 A1 * 7/2004 Liljeryd et al. ..... 375/242
2006/0036435 A1 * 2/2006 Kovesi et al. ..... 704/229
2007/0053513 A1 * 3/2007 Hoffberg ..... 380/201
2007/0225971 A1 * 9/2007 Bessette ..... 704/203

FOREIGN PATENT DOCUMENTS

EP 0 767 462 A2 4/1997
EP 1 160 977 A2 12/2001

OTHER PUBLICATIONS

N. Grbić, J. M. de Haan, I. Claesson, and S. Nordholm, "Design of Oversampled Uniform DFT Filter Banks with Reduced Inband Aliasing and Delay Constraints," International Symposium on Signal Processing and its Applications (ISSPA), Kuala Lumpur, Malaysia, Aug. 13-16, 2001, pp. 104-107.

* cited by examiner

*Primary Examiner* — Jakieda Jackson
(74) *Attorney, Agent, or Firm* — Sunstein Kann Murphy & Timbers LLP

(57) ABSTRACT

An audio enhancement refines a short-time spectrum. The refinement may reduce overlap between audio sub-bands. The sub-bands are transformed into sub-band short-time spectra. A portion of the spectra are time-delayed. The sub-band short-time spectrum and the time-delayed portion are filtered to obtain a refined sub-band short-time spectrum. The refined spectrum improves audio processing.

25 Claims, 8 Drawing Sheets

SPECTRAL REFINEMENT SYSTEM

PRIORITY CLAIM

This application claims the benefit of priority from European Patent Application No. 06024940.6, filed Dec. 1, 2006, which is incorporated by reference.

BACKGROUND OF THE INVENTION

1. Technical Field

The inventions relate to audio signal processing, and in particular, to spectral refinement of audio signals in communication systems.

2. Related Art

Background noise may distort the quality of an audio signal. Background noise may affect the intelligibility of a conversation on a hands-free device, a cellular phone, or other communication device. Audio signal processing, such as noise reduction and echo compensation, may improve intelligibility through a spectral subtraction. This method may dampen stationary noise and may require a positive signal-to-noise distance. Spectral subtraction may distort speech when spectral noise components are damped and not eliminated.

Audio signal processing may divide an audio signal into overlapping sub-bands. The sub-bands may be transformed into the frequency domain and multiplied by a window function. The frequency response of a window function may cause the sub-bands to overlap. The overlap may decrease noise damping in frequency ranges adjacent to the desired signals. When the discrete resolution is increased to reduce sub-band overlap, the modified resolution may decrease the time resolution of the processed signal. This process may cause undesirable and unacceptable time delays.

SUMMARY

A process refines a short-term spectrum to reduce sub-band overlap. A predetermined number of audio sub-bands provide sub-band short-time spectra. The sub-band short-time spectra are time delayed. The sub-band short-time spectrum and the time-delayed sub-band short-time spectra are filtered to obtain a refined sub-band short-time spectrum. The refined sub-band short-time spectrum may reduce overlapping of the sub-bands and improve processing of the audio signal. Noise reduction, echo compensation, and voice pitch estimation of the audio signal may be enhanced.

Other systems, methods, features, and advantages will be, or will become, apparent to one with skill in the art upon examination of the following figures and detailed description. It is intended that all such additional systems, methods, features and advantages be included within this description, be within the scope of the invention, and be protected by the following claims.

BRIEF DESCRIPTION OF THE DRAWINGS

The system may be better understood with reference to the following drawings and description. The components in the figures are not necessarily to scale, emphasis instead being placed upon illustrating the principles of the invention. Moreover, in the figures, like referenced numerals designate corresponding parts throughout the different views.

DETAILED DESCRIPTION OF THE PREFERRED EMBODIMENTS

A method refines a short-time spectrum of an audio signal. The refined sub-band short-time spectrum may reduce the sub-band overlap to improve the quality of an audio signal. A number of sub-bands of the audio signal are transformed to obtain sub-band short-time spectra. The short-time Fourier transform may window the audio signal and transform the windowed signal. The sub-band spectra are time delayed to obtain a predetermined number of time-delayed sub-band short-time spectra.

Hardware or software selectively passes elements of the sub-band short-time spectrum and the time-delayed sub-band short-time spectra to obtain a refined sub-band short-time spectrum. The hardware or software may selectively pass certain elements of the signal and eliminate or minimize others. A finite impulse response filter, for example, may pass certain frequencies but attenuate (or dampen) others. The filter may select pairs of neighbored sub-bands, filter the sub-band short-time spectrum, and time-delay the sub-band short-time spectra of the pairs of neighbored sub-bands. The signals may then be added. The result generates an augmented refined sub-band short-time spectrum.

Figure 1:
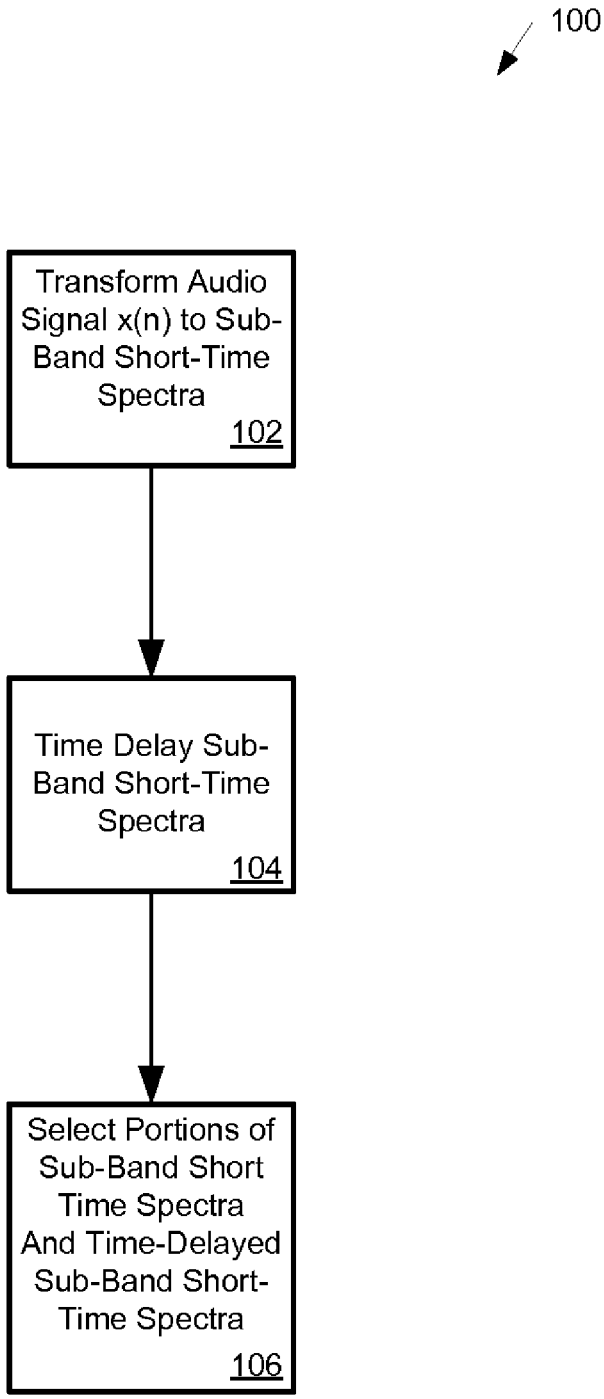
FIG. 1 is a process of spectral refinement of an audio signal.

FIG. 1 is a process 100 that refines the spectrum of an audio signal x(n). An audio signal x(n) of a length N may include elements $[x(n), x(n-1), \ldots, x(n-N+1)]^T$. At Act 102, the audio signal x(n) may be transformed to sub-band short-time spectra $X(e^{j\Omega_\mu}, n)$ by a short-time Fourier transform. The transformation may include a number of sub-bands $\Omega_\mu$. The short-time Fourier transform may include windowing, a discrete Fourier transformation, and/or other audio processing. The sub-band short-time spectra $X(e^{j\Omega_\mu}, n)$ of the audio signal x(n) may be substantially equal to for $$\sum_{k=0}^{N-1} x(n-k)h_k e^{-j\Omega_\mu k}$$

for frequency sub-bands $\Omega_\mu = 2\pi\mu/N$, where n is a discrete time index, $h_k$ are coefficients of a window function, and $\mu \in \{0, \ldots, N-1\}$. For certain applications, the audio signal x(n) may be transformed into the frequency domain for a particular frequency range. In speech signal processing, the selected frequency range may be below approximately 1500 Hz.

At Act 104, one or more of the sub-band short-time spectra $X(e^{j\Omega_\mu}, n)$ may be time-delayed to obtain a number M of time-delayed sub-band short-time spectra $X(e^{j\Omega_\mu}, n-(M-1)r)$, where r is an integer denoting a frame shift of the time-delayed sub-band short-time spectra. The time-delayed sub-band short-time spectra $X(e^{j\Omega_\mu}, n-(M-1)r)$ and the sub-band short-time spectra $X(e^{j\Omega_\mu}, n)$ may be filtered at Act 106 to obtain an augmented spectrum (e.g., a refined sub-band short-time spectrum $\tilde{X}(e^{j\Omega_\mu}, n)$). The filtering may comprise a finite impulse response, infinite impulse response, or another type of filter. The refined sub-band short-time spectrum $\tilde{X}(e^{j\Omega_\mu}, n)$ may be equal or about equal to $$\sum_{k=0}^{\tilde{N}-1} x(n-k)\tilde{h}_k e^{-j\Omega_\mu k},$$

where the length $\tilde{N}$ is greater than the length N, $\tilde{N}=k_0 N=N+r(M-1)$, and $k_0 \geqq 2$.

The filtering at Act 106 may include using a refinement matrix S that may be an algebraic mapping of the M short-time spectra, as shown by:

$$S\begin{bmatrix} X(e^{j\Omega}, n) \\ \vdots \\ \vdots \\ X(e^{j\Omega}, n-(M-1)r) \end{bmatrix} = \tilde{X}(e^{j\Omega}, n),$$

where the sub-band short-time spectra $X(e^{j\Omega}, n)=[X(e^{j\Omega_0}, n), \ldots, X(e^{j\Omega_{N-1}}, n)]^T$ and the refined sub-band short-time spectra $\tilde{X}(e^{j\Omega}, n)=[\tilde{X}(e^{j\Omega_0}, n), \ldots, \tilde{X}(e^{j\Omega_{N-1}}, n)]^T$. The refinement matrix S may have a size $\tilde{N}\times NM$. The refinement matrix S may include the sub-band short-time spectra $X(e^{j\Omega_\mu}, n)$ at time n, and the time-delayed sub-band short-time spectra $X(e^{j\Omega_\mu}, n-(M-1)r)$ at times n−kr. The refined spectra $\tilde{X}(e^{j\Omega}, n)$ may be derived from the number M of previous input spectra $X(e^{j\Omega}, n)$ that are respectively shifted by the frame shift integer r, as in $X(e^{j\Omega}, n-r)$, $X(e^{j\Omega}, n-2r)$, . . . $X(e^{j\Omega}, n-(M-1)r)$.

The refinement matrix S may be based on the following constraint matrix A for the window function $\tilde{h}$:

$$A = \begin{bmatrix} h \\ h \\ \vdots \\ h \end{bmatrix}^T = \tilde{h},$$

with $$A_{i,j} = \begin{cases} a_0, & \text{if } [0 < i \leq N \text{ and } (j = i)] \\ a_1, & \text{if } [N < i \leq 2N \text{ and } j = i - N + r] \\ a_k, & \text{if } [kN < i \leq (k+1)N \text{ and } j = i + k(r-N)] \\ \vdots & \\ a_{M-1}, & \text{if } [(M-1)N < i \leq MN) \text{ and } j = i + (M-1)(r-n)] \\ 0, & \text{else} \end{cases},$$

where the indices i and j denote the index of the column and row of the refinement matrix S, respectively. The length of the window function $\tilde{h}$ may be $\tilde{N}=N+r(M-1)$. Therefore, the window function $\tilde{h}$ may comprise weighted sums of shifted window functions h of order N. Observing the constraint matrix A, the refinement matrix S may be calculated from:

$$SD_{Block}\begin{bmatrix} H & 0 & \cdots & 0 \\ 0 & H & \cdots & 0 \\ \vdots & \vdots & \ddots & \vdots \\ 0 & 0 & \cdots & H \end{bmatrix}\begin{bmatrix} x(n) \\ x(n-r) \\ \vdots \\ x(n-(M-1)r) \end{bmatrix} = D_{\tilde{N}}\tilde{H}\tilde{x}(n), \text{ and}$$

-continued $$D_{\tilde{N}}\tilde{H}\tilde{x}(n) = D_{\tilde{N}}A\begin{bmatrix} H & 0 & \cdots & 0 \\ 0 & H & \cdots & 0 \\ \vdots & \vdots & \ddots & \vdots \\ 0 & 0 & \cdots & H \end{bmatrix}\begin{bmatrix} x(n) \\ x(n-r) \\ \vdots \\ x(n-(M-1)r) \end{bmatrix}.$$

The filter coefficients that may be applied at Act 106 for the i-th sub-band may be given as $g_{i,ik_0}=[g_{i,ik_0,1}, \ldots, g_{i,ik_0,\mathcal{M}-1}]^T$. Each filter coefficient may be determined by $g_{i,ik_0,m}=S(ik_0, i+mN)$, where $S(ik_0, i+mN)$ are the coefficients of the refinement matrix S. The coefficients of the refinement matrix S may be calculated from:

$$S(i, mN+1) = \frac{a_m}{N}\frac{\sin\left(\pi\left(\frac{iN-1\tilde{N}}{\tilde{N}}\right)\right)e^{-j\pi\left(\frac{iN-1\tilde{N}}{\tilde{N}}\right)}}{\sin\left(\pi\left(\frac{iN-1\tilde{N}}{N\tilde{N}}\right)\right)e^{-j\pi\left(\frac{iN-1\tilde{N}}{N\tilde{N}}\right)}}e^{-j\frac{2\pi}{N}imr}.$$

Because $\tilde{N}=k_0 N$, with $k_0$ being an integer $\geqq 2$, the coefficients of the refinement matrix S may be rewritten as:

$$S(i, mN+1) = \begin{cases} 0, & \text{if } [(i/k_0 \in Z) \text{ and } (1/N \notin Z)] \\ a_m e^{-j\frac{2\pi}{N}imr}, & \text{if } [(i/k_0 \in Z) \text{ and } (1/N \in Z)] \\ \frac{a_m}{N}\frac{\sin\left(\pi\left(\frac{i}{k_0}-1\right)\right)e^{-j\pi\left(\frac{i}{k_0}-1\right)}}{\sin\left(\pi\left(\frac{i-1k_0}{Nk_0}\right)\right)e^{-j\pi\left(\frac{i-1k_0}{k_0N}\right)}}e^{-j\frac{2\pi}{N}imr}, & \text{else} \end{cases}$$

where $a_m$ are the coefficients of the constraint matrix A (m=0, . . . , M−1), $1\in\{0, 1, \ldots, N-1\}$, and Z denotes the set of integers. Therefore, each $k_0$-th row of the refinement matrix S may be sparsely populated such that the elements of each $k_0$-th row are zero or near zero except for the column indices that are multiples of N. A sparsely populated refinement matrix may be derived relatively quickly and efficiently and may not require a large amount of computing resources.

The sub-band short-time spectra $X(e^{j\Omega}, n)$ and the refined sub-band short-time spectra $\tilde{X}(e^{j\Omega}, n)$ may be derived through a discrete Fourier transform matrix DL with the equations $X(e^{j\Omega},n)=D_N H x(n)$ and $\tilde{X}(e^{j\Omega},n)=D_{\tilde{N}}\tilde{H}\tilde{x}(n)$, respectively, where $\tilde{x}(n)$ is an augmented signal vector $\tilde{x}(n)=[x(n), x(n-1), \ldots, x(n-N+1), \ldots, x(n-N+1)]^T$. The diagonal matrices H and H of the window function h and h may be:

$$H = diag\{h\} = \begin{bmatrix} h_0 & 0 & 0 & \cdots & 0 \\ 0 & h_1 & 0 & \cdots & 0 \\ 0 & 0 & h_2 & \cdots & 0 \\ 0 & \vdots & \vdots & \ddots & \vdots \\ 0 & 0 & 0 & \cdots & h_{N-1} \end{bmatrix} \text{ and}$$

-continued $$\tilde{H} = diag\{\tilde{h}\} = \begin{bmatrix} \tilde{h}_0 & 0 & 0 & \cdots & 0 \\ 0 & \tilde{h}_1 & 0 & \cdots & 0 \\ 0 & 0 & \tilde{h}_2 & \cdots & 0 \\ 0 & \vdots & \vdots & \ddots & \vdots \\ 0 & 0 & 0 & \cdots & \tilde{h}_{\tilde{N}-1} \end{bmatrix}.$$

Accordingly, the discrete Fourier transform matrix DL may be:

$$D_L = \begin{bmatrix} 1 & 1 & 1 & \cdots & 1 \\ 1 & e^{-j\frac{2\pi}{L}} & e^{-j2\frac{2\pi}{L}} & \cdots & e^{-j(L-1)\frac{2\pi}{L}} \\ 1 & e^{-j2\frac{2\pi}{L}} & e^{-j4\frac{2\pi}{L}} & \cdots & e^{-j2(L-1)\frac{2\pi}{L}} \\ 1 & \vdots & \vdots & \ddots & \vdots \\ 1 & e^{-j(L-1)\frac{2\pi}{L}} & e^{-j2(L-1)\frac{2\pi}{L}} & \cdots & e^{-j(L-1)(L-1)\frac{2\pi}{L}} \end{bmatrix} \text{ with } L \in \{N, \tilde{N}\}.$$

Figure 2:
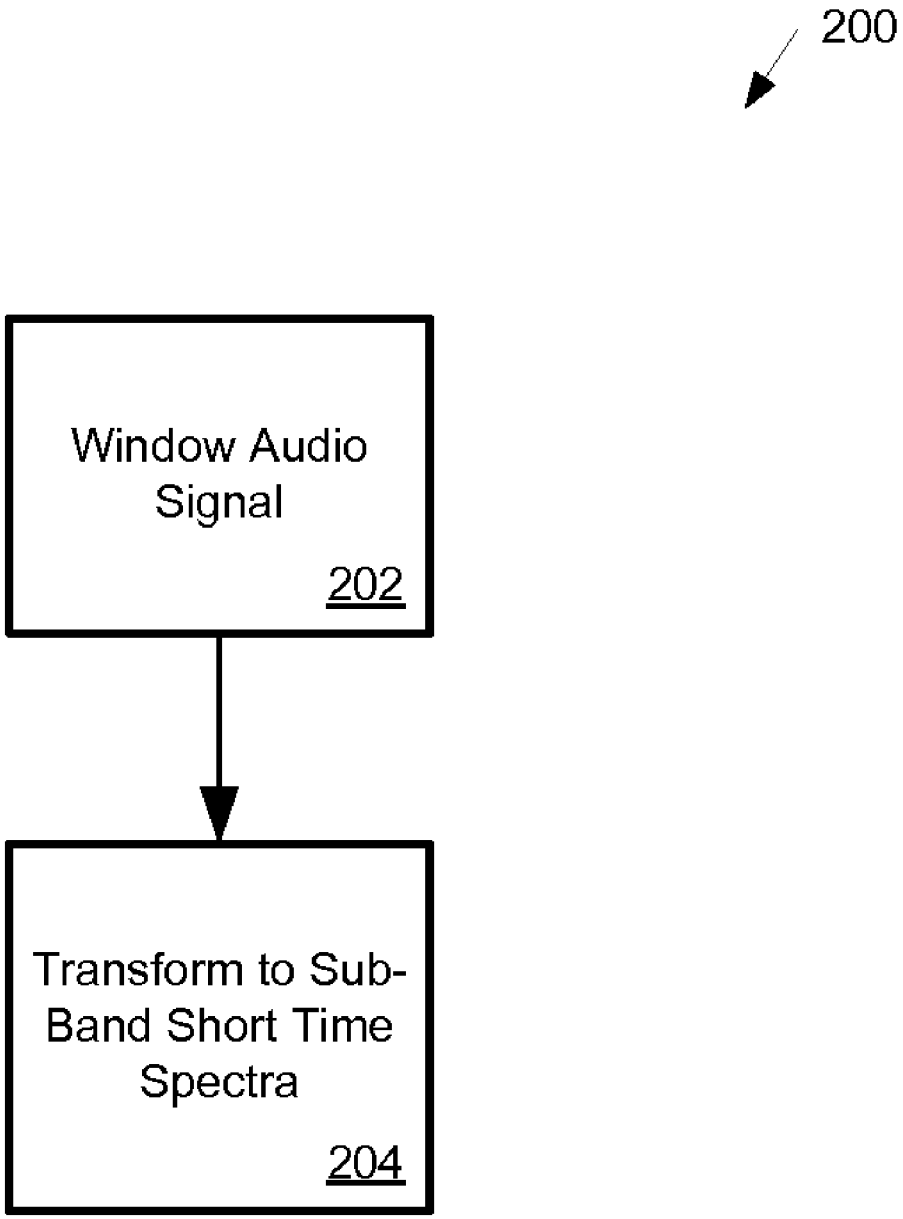
FIG. 2 is a process of short-time Fourier transformation of an audio signal.

FIG. 2 is a process 200 of that transforms an audio signal x(n). The process 200 may correspond to a short-time Fourier transformation of the audio signal x(n) at Act 102 of FIG. 1. At Act 202, the audio signal x(n) may be processed by a window function, such as a Hann window, a Hamming window, a Gaussian window, or other window function. The window function may include window coefficients $h_k$. The audio signal x(n) may be of a length N and include elements $[x(n), x(n-1), \ldots, x(n-N+1)]^T$. The windowed signal may be converted to the frequency domain by a discrete Fourier transform at Act 204. The conversion may yield a sub-band short-time spectra $X(e^{j\Omega_\mu}, n)$ in the frequency domain, for a predetermined number of sub-bands $\Omega_\mu$. The sub-band short-time spectra $X(e^{j\Omega_\mu}, n)$ of the audio signal x(n) may be equal to $$\sum_{k=0}^{N-1} x(n-k)h_k e^{-j\Omega_\mu k}$$

for frequency sub-bands $\Omega_\mu = 2\pi\mu/N$, where n is a discrete time index, $h_k$ are coefficients of the window function, and $\mu \in \{0, \ldots, N-1\}$.

Figure 3:
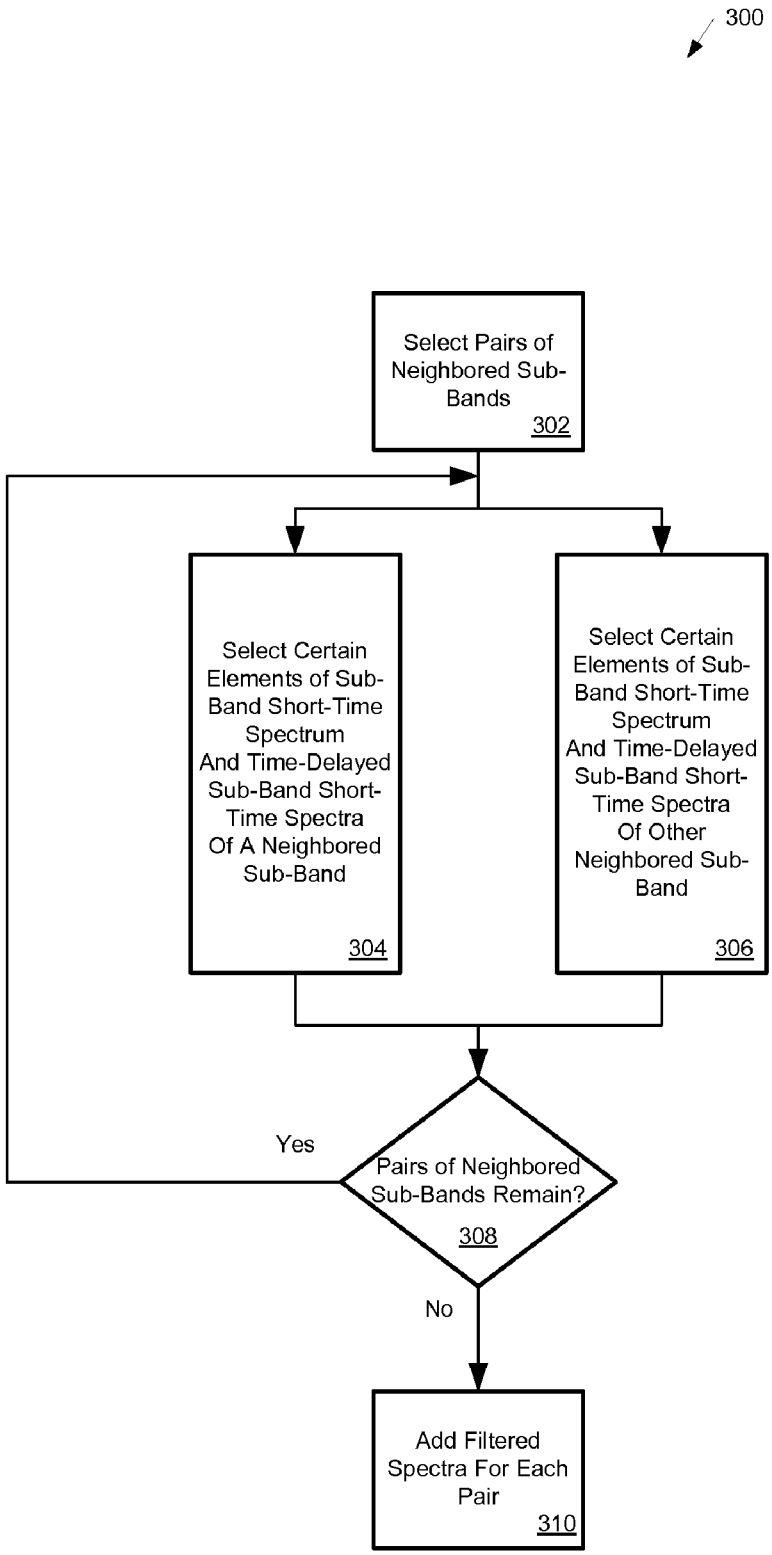
FIG. 3 is a process of filtering an audio signal to obtain an augmented refined spectrum.

FIG. 3 is a process 300 that selectively passes portions of an audio signal to obtain an augmented refined spectrum while dampening other portions. The process 300 may correspond to filtering the sub-band short-time spectra and time-delayed short-time spectra at Act 106 of FIG. 1. The process 300 may interpolate the sub-band short-time spectra for sub-bands that are not present in the sub-band short-time spectra $X(e^{j\Omega_\mu}, n)$. The interpolated sub-band short-time spectra may be weighted sums of the sub-band short-time spectra that were present in the sub-band short-time spectrum $X(e^{j\Omega}, n)$. At Act 302, pairs of neighbored frequency sub-bands $\Omega_\mu$ in the sub-band short-time spectrum $X(e^{j\Omega}, n)$ may be selected. Some or all of the neighboring sub-bands may overlap.

Each pair of neighbored sub-bands may be filtered at Acts 304 and 306. At Act 304, the sub-band short-time spectrum $X(e^{j\Omega}, n)$ and corresponding time-delayed sub-band short-time spectra $X(e^{j\Omega_\mu}, n-(M-1)r)$ of one of the neighbored sub-band pairs may be filtered to obtain a first filtered spectrum. At Act 306, the sub-band short-time spectrum $X(e^{j\Omega}, n)$ and corresponding time-delayed sub-band short-time spectra $X(e^{j\Omega_\mu}, n-(M-1)r)$ of the other neighbored sub-band pair may be filtered to obtain a second filtered spectrum. Acts 304 and 306 may be performed simultaneously or at different times (e.g., in sequence). The filtering in Acts 304 and 306 may use the same or different filter coefficients. The filtering may comprise a finite impulse response filter, an infinite impulse response filter, or other types of filters.

Act 308 determines whether pairs of neighbored sub-bands remain from the selection of neighbored sub-bands from Act 302. If pairs of neighbored sub-bands remain, Acts 304 and 306 may be repeated for the remaining pairs. If no more pairs of neighbored sub-bands remain, then the process 300 continues at Act 310. At Act 310, the first and second filtered spectra may be added to create an additional refined sub-band short-time spectrum $\tilde{X}(e^{j\Omega}, n)$ for each of the pairs of selected sub-bands $\Omega_\mu$. The additional refined sub-band short-time spectrum $\tilde{X}(e^{j\Omega}, n)$ may be created by:

$$\tilde{X}(e^{j\Omega_1}, n) = \begin{cases} \sum_{m=0}^{M-1} g_{1/k_0,1,m} X\left(e^{j\Omega_{1/k_0}}, n-mr\right), & \text{if } 1/k_0 \text{ integer} \\ \sum_{m=0}^{M-1} g_{\lfloor 1/k_0 \rfloor,1,m} X\left(e^{j\Omega_{\lfloor 1/k_0 \rfloor}}, n-mr\right) + \\ \sum_{m=0}^{M-1} g_{\lceil 1/k_0 \rceil,1,m} X\left(e^{j\Omega_{\lceil 1/k_0 \rceil}}, n-mr\right), & \text{else} \end{cases}$$

else where $\lfloor\ \rfloor$ and $\lceil\ \rceil$ denote rounding to the next smaller integer and to the next larger integer, respectively, and g(i, l, m)=S(l, i+mN).

Figure 4:
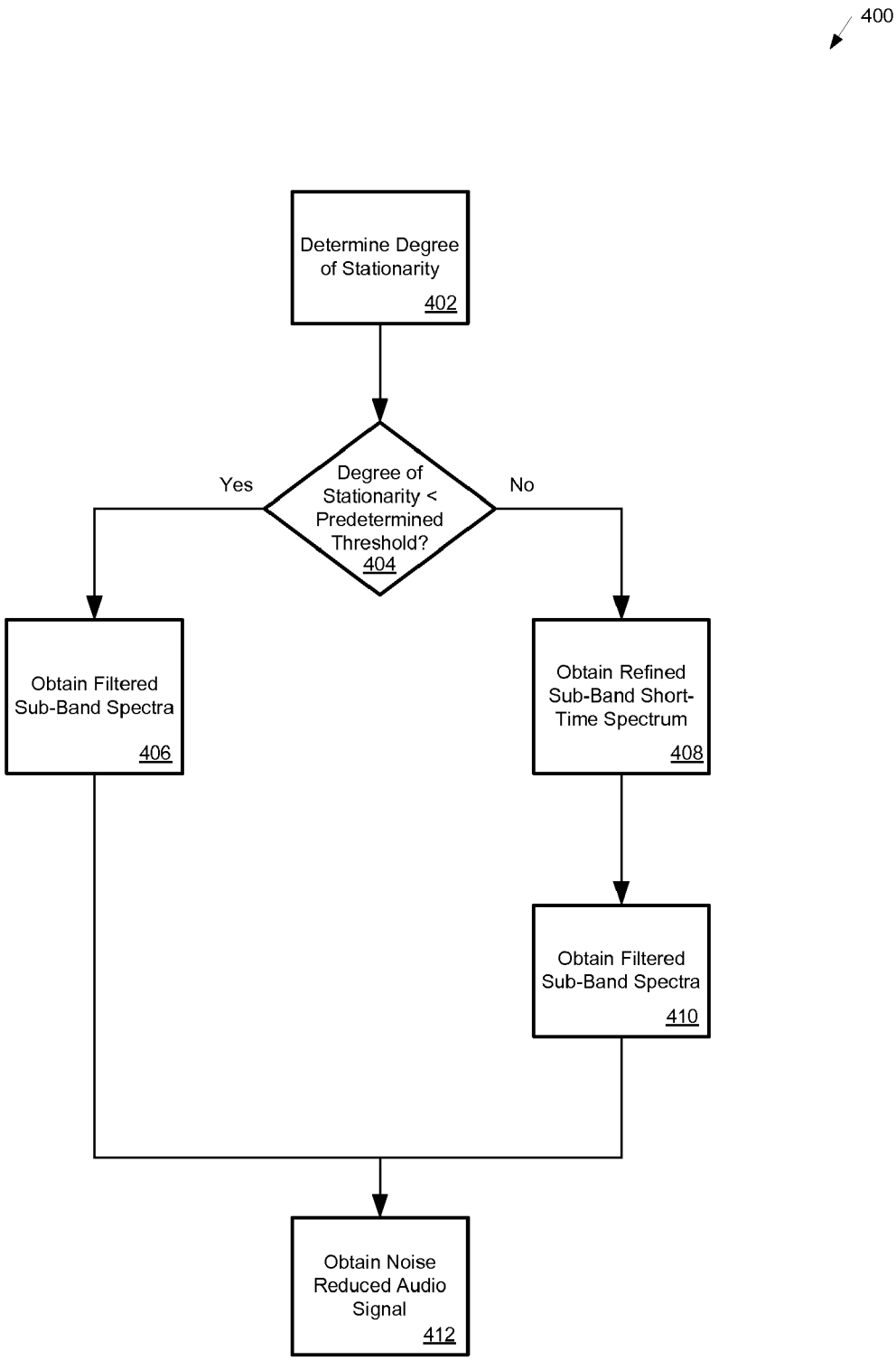
FIG. 4 is a process of noise reduction of an audio signal.

FIG. 4 is a process 400 that reduces noise in an audio signal x(n). The process 400 may use a refined sub-band short-time spectrum to obtain a noise reduced audio signal. A degree of stationarity of the audio signal x(n) may be determined at Act 402. At Act 404, the degree of stationarity is compared to a predetermined threshold. If the degree of stationarity is less than the predetermined threshold, the audio signal x(n) may be filtered and yield a filtered sub-band spectra $\hat{S}(e^{j\Omega}, n)$ at Act 406. A refined short-time spectrum is not used at Act 406. The noise reduction filter may comprise a Wiener filter, which may reduce noise in the audio signal x(n). The noise reduction may be based on the estimated short-time power density of noise and the short-time power density of the audio signal x(n). Other types of filters may also be used.

If the degree of stationarity is equal to or greater than the predetermined threshold, the process 400 continues at Act 408. At Act 408, the audio signal x(n) may be refined to obtain a refined sub-band short-time spectrum $\tilde{X}(e^{j\Omega}, n)$. The refined sub-band short-time spectrum $\tilde{X}(e^{j\Omega}, n)$ may be filtered at Act 410 to obtain a filtered sub-band spectra $\hat{S}(e^{j\Omega}, n)$. In this case, the noise reduction filter may reduce noise in the audio signal x(n) based on the estimated short-time power density of noise and the short-time power density of the refined sub-band short-time spectrum $\tilde{X}(e^{j\Omega}, n)$.

At Act 412, the filtered sub-band spectra $\hat{S}(e^{j\Omega}, n)$ may be converted into the time domain (e.g., a continuous domain) by an inverse discrete Fourier transform. The signal may be synthesized to obtain a noise reduced audio signal. Acts 406 or 410 may produce the filtered sub-band spectra $\hat{S}(e^{j\Omega}, n)$. The noise reduced audio signal may be transmitted to a speaker, cellular telephone, or further processed. Noise reduction based on the refined sub-band short-time spectrum $\tilde{X}(e^{j\Omega}, n)$ may be performed if the audio signal x(n) has a predetermined threshold of stationarity. The predetermined threshold of stationarity may be selected such that spectral refinement is performed only if the time delay resulting from the spectral refinement is acceptable for the particular application.

Figure 5:
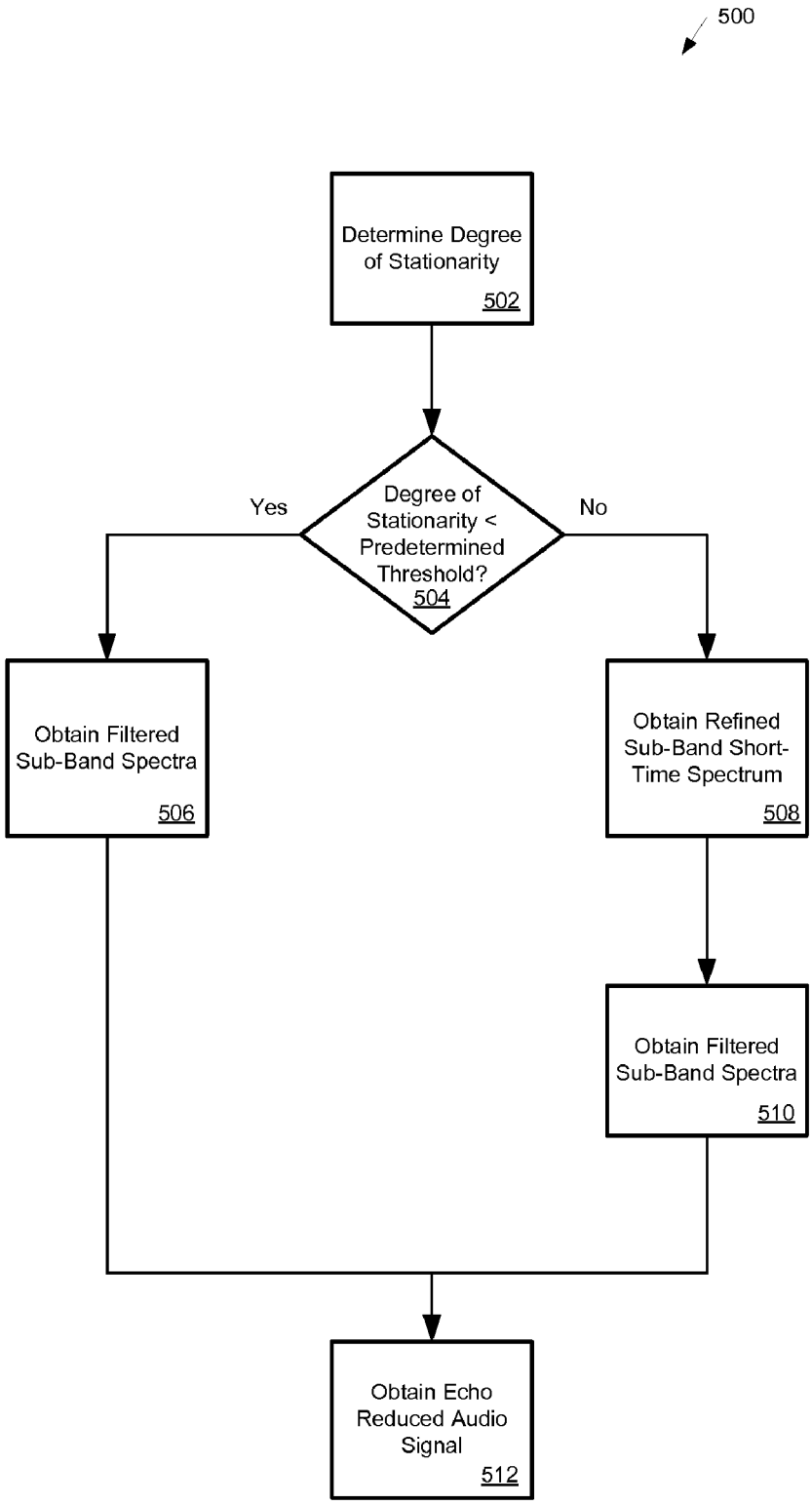
FIG. 5 is a process of echo reduction of an audio signal.

FIG. 5 is a process 500 that reduces echo in an audio signal x(n). The process 500 may use a refined sub-band short-time spectrum to obtain an echo reduced audio signal. A degree of stationarity of the audio signal x(n) may be determined at Act 502. At Act 504, the degree of stationarity is compared to a predetermined threshold. If the degree of stationarity is less than the predetermined threshold, echo may be dampened from the audio signal x(n) to generate a filtered sub-band spectra $\hat{S}(e^{j\Omega}, n)$ at Act 506. The echo reduction filter may reduce echo by a spectral subtraction.

If the degree of stationarity is equal to or greater than the predetermined threshold, the audio signal x(n) may be refined at Act 508. A refined sub-band short-time spectrum $\tilde{X}(e^{j\Omega}, n)$ may be generated. Echo may be minimized in the refined sub-band short-time spectrum $\tilde{X}(e^{j\Omega}, n)$ through an echo reduction filter at Act 510. The echo reduction filter may perform spectral subtraction based on the refined sub-band short-time spectrum $\tilde{X}(e^{j\Omega}, n)$.

At Act 512, the filtered sub-band spectra $\hat{S}(e^{j\Omega}, n)$ may be transformed into a continuous domain and synthesized to obtain an echo reduced audio signal. The filtered sub-band spectra $\hat{S}(e^{j\Omega}, n)$ may be produced at Acts 506 or 510. The echo reduced audio signal may be transmitted to a speaker, cellular telephone, or a remote processor. Echo reduction may be performed when the audio signal x(n) has at least the predetermined threshold of stationarity. The predetermined threshold of stationarity may be pre-programmed.

Figure 6:
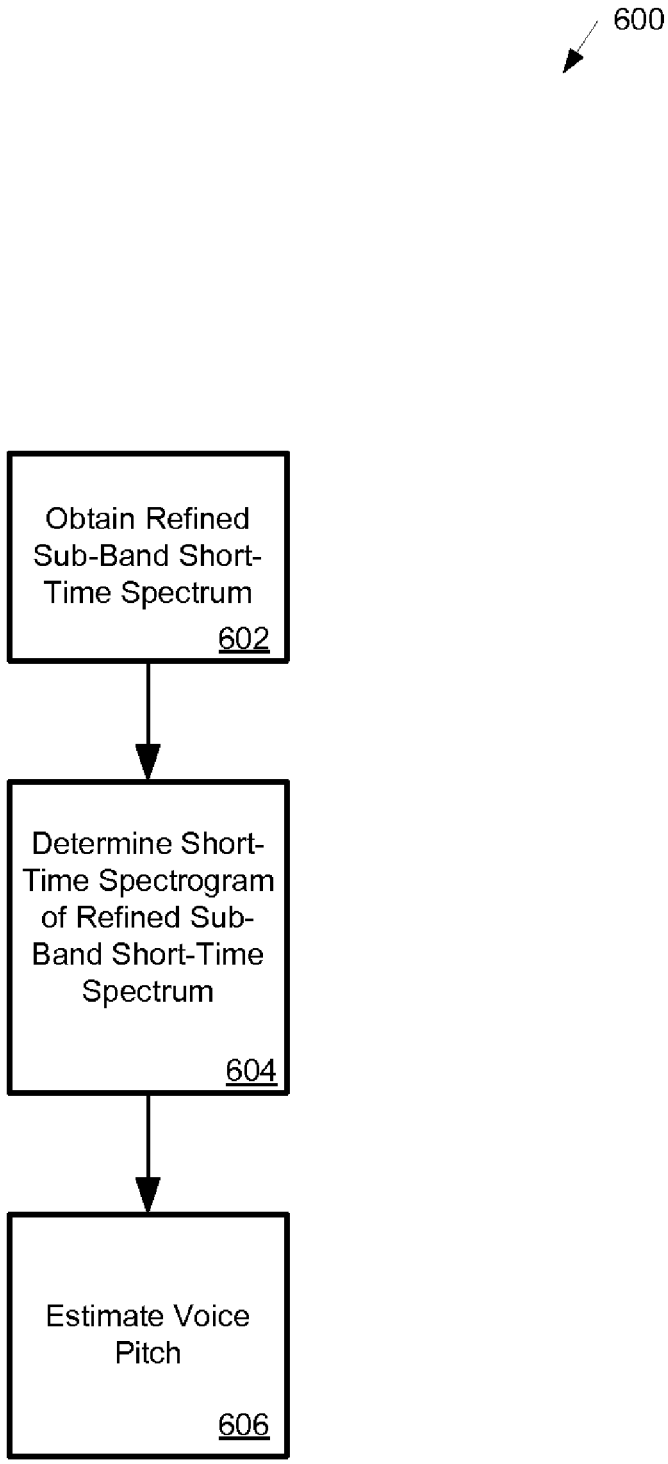
FIG. 6 is a process of voice pitch estimation of an audio signal.

FIG. 6 is a process 600 that estimates the pitch of an audio signal x(n). The process 600 may use a refined sub-band short-time spectrum to estimate a voice pitch. Speech recognition and speech synthesis systems may utilize the pitch of speech to improve accuracy and reliability. At Act 602, the audio signal x(n) may be refined to obtain a refined sub-band short-time spectrum $\tilde{X}(e^{j\Omega}, n)$. A short-time spectrogram of the refined sub-band short-time spectrum $\tilde{X}(e^{j\Omega}, n)$ may be determined at Act 604. The short-time spectrogram for a frequency sub-band $\Omega_\mu$ may be written as $|\tilde{X}(e^{j\Omega_\mu}, n)|^2$. The short-time spectrogram may estimate the voice pitch in the audio signal x(n) at Act 606. A refined sub-band short-time spectrum $\tilde{X}(e^{j\Omega_\mu}, n)$ may improve the estimate of the pitch of speech in the audio signal x(n).

Figure 7:
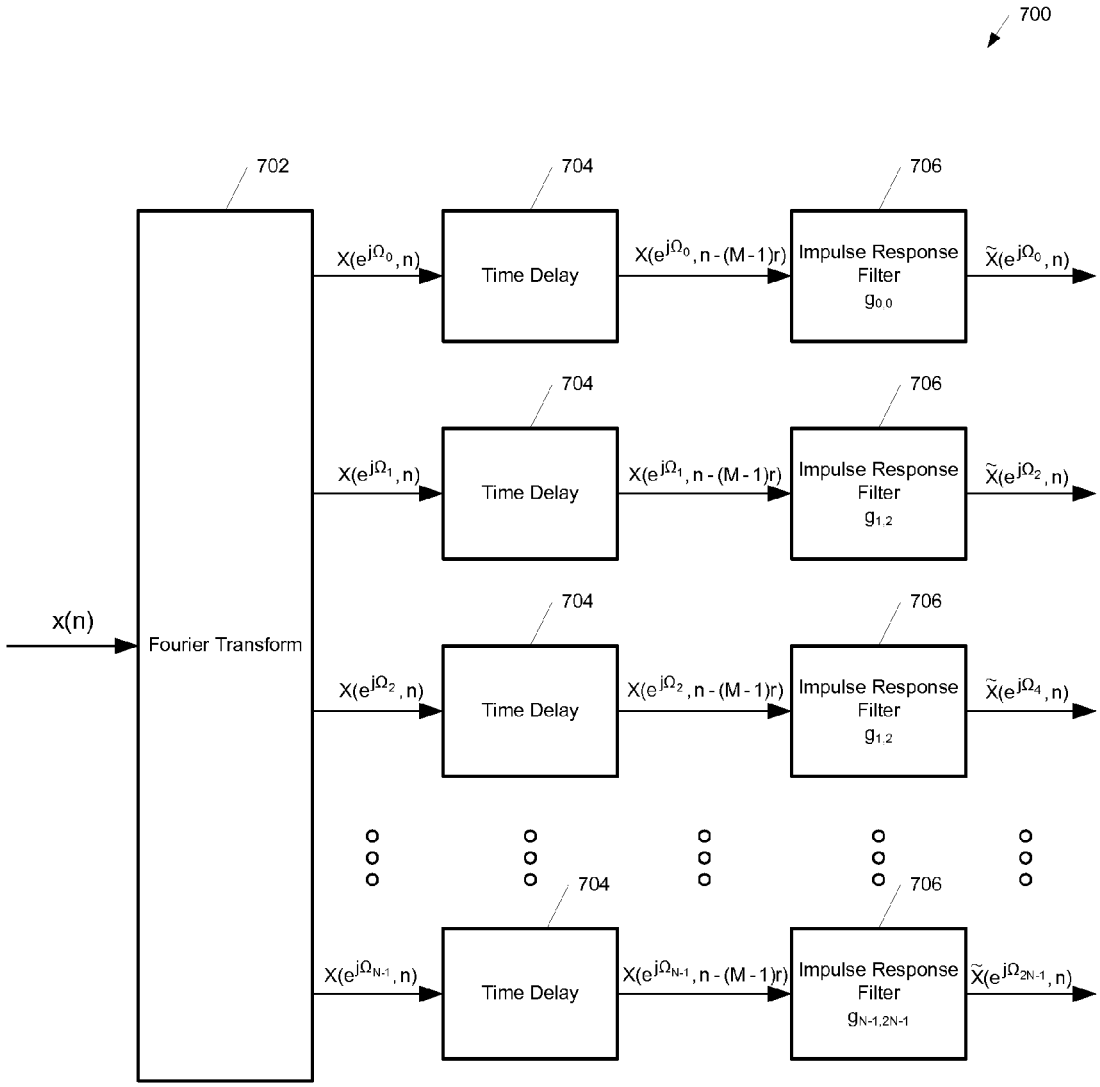
FIG. 7 is a spectral refinement system.

FIG. 7 is a spectral refinement system 700. An audio signal x(n) may be received and processed to a refined sub-band short-time spectrum $\tilde{X}(e^{j\Omega_\mu}, n)$. The audio signal x(n) may be of a length N, and include elements $[x(n), x(n-1), \ldots, x(n-N+1)]^T$. Short-time Fourier transform logic 702 may process the audio signal x(n) to sub-band short-time spectra $X(e^{j\Omega_\mu}, n)$ for a predetermined number of sub-bands $\Omega_\mu$ of the audio signal x(n). The short-time Fourier transform logic 702 may include windowing logic and discrete Fourier transform logic. The windowing logic may multiply a window function to the audio signal x(n). The window function may comprise a Hann window, a Hamming window, a Gaussian window, or other function. The discrete Fourier transform logic may transform the windowed signal to the sub-band short-time spectra $X(e^{j\Omega_\mu}, n)$.

Time delay filters 704 may filter the sub-band short-time spectra $X(e^{j\Omega_\mu}, n)$ to obtain a predetermined number M of time-delayed sub-band short-time spectra $X(e^{j\Omega_\mu}, n-(M-1)r)$, where r is a frame shift of the time-delayed sub-band short-time spectra. The sub-band short-time spectra $X(e^{j\Omega_\mu}, n)$ and time-delayed sub-band short-time spectra $X(e^{j\Omega_\mu}, n-(M-1)r)$ may be filtered by refinement filters 706 to obtain refined sub-band short-time spectra $\tilde{X}(e^{j\Omega}, n)$. The refinement filters 706 may include finite impulse response filters, infinite impulse response filters, or other types of filters. The refined sub-band short-time spectra $\tilde{X}(e^{j\Omega}, n)$ for the i-th sub-band may be obtained by $$\tilde{X}\left(e^{j\Omega_{ik_0}}, n\right) = g_{i,ik_0,0}X(e^{j\Omega_i}, n) + .. + g_{i,ik_0,M-1}X(e^{j\Omega_i}, n-(M-1)r),$$

$$\text{where } g_{i,ik_0,m} = S(ik_0, i+mN).$$

In FIG. 7, the spectral refinement may be performed by the refinement filters 706 applied in each sub-band with the coefficients $g_{i,ik_0}=[g_{i,ik_0,0}, g_{i,ik_0,1}, \ldots, g_{i,ik_0,M-1}]^T$ in the i-th sub-band for the integer $k_0=2$.

Figure 8:
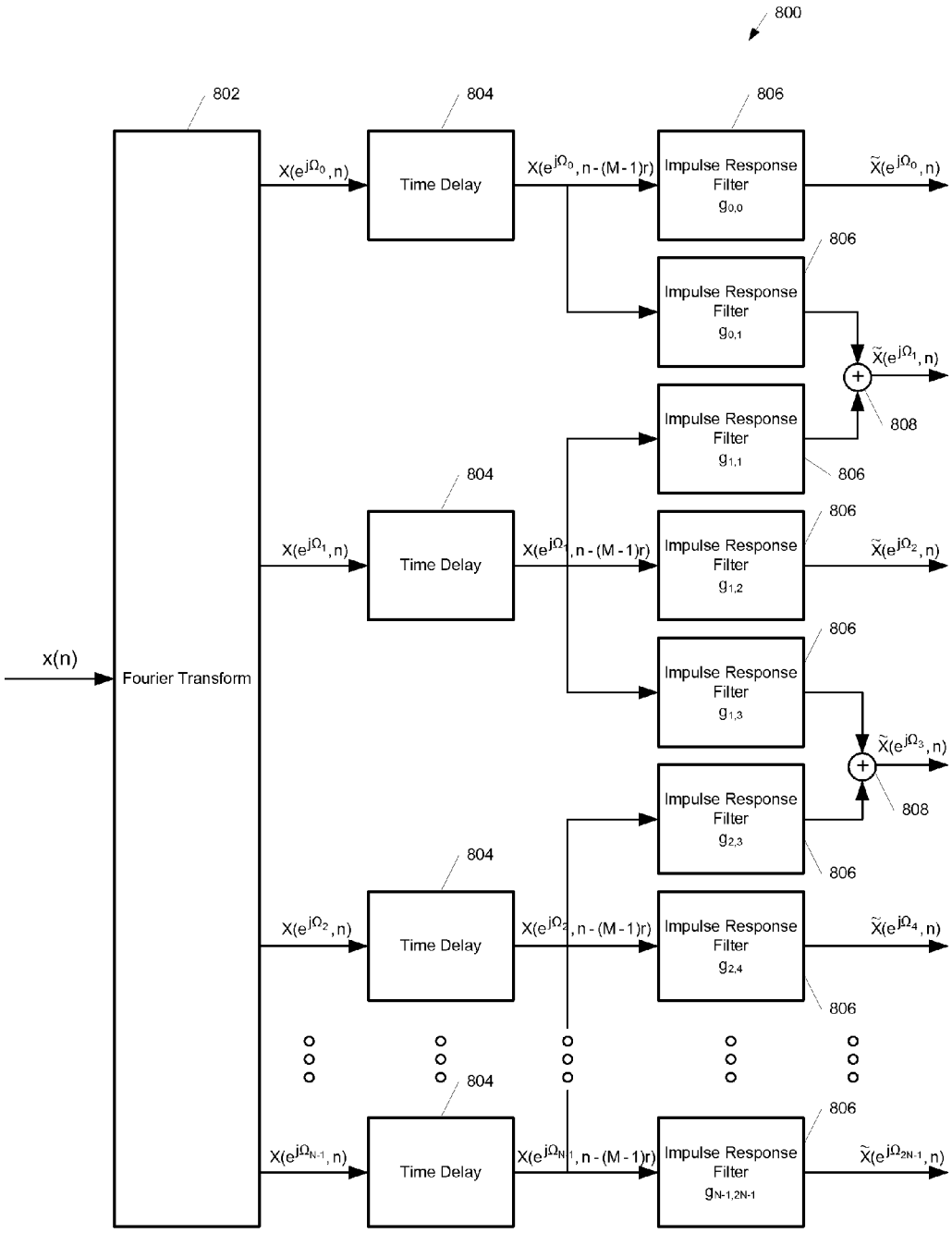
FIG. 8 is an alternative spectral refinement system.

FIG. 8 is an alternative spectral refinement system 800. An audio signal x(n) may be processed into a refined sub-band short-time spectrum $\tilde{X}(e^{j\Omega_\mu}, n)$. The audio signal x(n) may be of a length N, and include elements $[x(n), x(n-1), \ldots, x(n-N+1)]^T$. Short-time Fourier transform logic 802 may convert the audio signal x(n) to sub-band short-time spectra $X(e^{j\Omega_\mu}, n)$ for a predetermined number of sub-bands $\Omega_\mu$. The short-time Fourier transform logic 802 may include windowing logic and discrete Fourier transform logic. Time delay filters 804 may select the sub-band short-time spectra $X(e^{j\Omega_\mu}, n)$ to obtain a predetermined number M of time-delayed sub-band short-time spectra $X(e^{j\Omega_\mu}, n-(M-1)r)$, where r is a frame shift of the time-delayed sub-band short-time spectra.

Audio processing applications may be enhanced by using sub-band short-time spectra for sub-bands that may not be present in the sub-band short-time spectra $X(e^{j\Omega_\mu}, n)$. Interpolation of sub-band short-time spectra may result in weighted sums of the sub-band short-time spectra that were present in the sub-band short-time spectrum $X(e^{j\Omega}, n)$. Pairs of neighbored frequency sub-bands $\Omega_\mu$ in the sub-band short-time spectrum $X(e^{j\Omega}, n)$ may be selected. The neighboring sub-bands may or may not overlap. Each pair of neighbored sub-bands may be filtered by refinement filters 806. The sub-band short-time spectrum $X(e^{j\Omega}, n)$ and corresponding time-delayed sub-band short-time spectra $X(e^{j\Omega_\mu}, n-(M-1)r)$ of one of the neighbored sub-bands in a pair may be filtered to obtain a first filtered spectrum. The sub-band short-time spectrum $X(e^{j\Omega}, n)$ and corresponding time-delayed sub-band short-time spectra $X(e^{j\Omega_\mu}, n-(M-1)r)$ of the other neighbored sub-band in a pair may be filtered to obtain a second filtered spectrum. The filtering may include finite impulse response filtering, infinite impulse response filtering, or another type of filtering.

The first and second filtered spectra may be summed in adders 808 to obtain an additional refined sub-band short-time spectrum $\tilde{X}(e^{j\Omega}, n)$ for each of the pairs of selected sub-bands $\Omega_\mu$. The additional refined sub-band short-time spectrum $\tilde{X}(e^{j\Omega}, n)$ may be obtained as follows:

$$\tilde{X}(e^{j\Omega_1}, n) = \begin{cases} \sum_{m=0}^{M-1} g_{1/k_0,1,m}X\left(e^{j\Omega_{1/k_0}}, n-mr\right), & \text{if } 1/k_0 \text{ integer} \\ \sum_{m=0}^{M-1} g_{\lfloor 1/k_0 \rfloor,1,m}X\left(e^{j\Omega_{\lfloor 1/k_0 \rfloor}}, n-mr\right) + & \\ \sum_{m=0}^{M-1} g_{\lceil 1/k_0 \rceil,1,m}X\left(e^{j\Omega_{\lceil 1/k_0 \rceil}}, n-mr\right), & \text{else} \end{cases}$$

else where $\lfloor\ \rfloor$ and $\lceil\ \rceil$ denote rounding to the next smaller integer and to the next larger integer, respectively, and g(i, l, m)=S(l, i+mN).

Each of the processes described may be encoded in a computer readable medium such as a memory, programmed within a device such as one or more integrated circuits, one or more processors or may be processed by a controller or a computer. If the processes are performed by software, the software may reside in a memory resident to or interfaced to a storage device, a communication interface, or non-volatile or volatile memory in communication with a transmitter. The memory may include an ordered listing of executable instructions for implementing logical functions. A logical function or any system element described may be implemented through optic circuitry, digital circuitry, through source code, through analog circuitry, or through an analog source, such as through an electrical, audio, or video signal. The software may be embodied in any computer-readable or signal-bearing medium, for use by, or in connection with an instruction executable system, apparatus, or device. Such a system may include a computer-based system, a processor-containing system, or another system that may selectively fetch instructions from an instruction executable system, apparatus, or device that may also execute instructions.

A "computer-readable medium," "machine-readable medium," "propagated-signal" medium, and/or "signal-bearing medium" may comprise any device that contains, stores, communicates, propagates, or transports software for use by or in connection with an instruction executable system, apparatus, or device. The machine-readable medium may selectively be, but not limited to, an electronic, magnetic, optical, electromagnetic, infrared, or semiconductor system, apparatus, device, or propagation medium. A non-exhaustive list of examples of a machine-readable medium would include: an electrical connection having one or more wires, a portable magnetic or optical disk, a volatile memory such as a Random Access Memory "RAM", a Read-Only Memory "ROM", an Erasable Programmable Read-Only Memory (EPROM or Flash memory), or an optical fiber. A machine-readable medium may also include a tangible medium upon which software is printed, as the software may be electronically stored as code or an image or in another format (e.g., through an optical scan), then compiled, and/or interpreted or otherwise processed. The processed medium may then be stored in a computer and/or machine memory.

Although selected aspects, features, or components of the implementations are depicted as being stored in memories, all or part of the systems, including processes and/or instructions for performing processes, consistent with a spectral refinement system may be stored on, distributed across, or read from other machine-readable media, for example, secondary storage devices such as distributed hard disks, floppy disks, and CD-ROMs; a signal received from a network; or other forms of ROM or RAM, some of which may be written to and read from within a vehicle component.

Specific components of a system implementing spectral refinement may include additional or different components. A controller may be implemented as a microprocessor, microcontroller, application specific integrated circuit (ASIC), discrete logic, or a combination of other types of circuits or logic. Similarly, memories may comprise DRAM, SRAM, or other types of memory. Parameters (e.g., conditions), databases, and other data structures that retain the data and/or programmed processes may be distributed across platforms or devices, separately stored and managed, may be incorporated into a single memory or database, or may be logically and physically organized in many different ways. Programs and instruction sets may be parts of a single program, separate programs, or distributed across several memories and processors.

While various embodiments of the invention have been described, it will be apparent to those of ordinary skill in the art that many more embodiments and implementations are possible within the scope of the invention. Accordingly, the invention is not to be restricted except in light of the attached claims and their equivalents.

We claim:

1. A method of processing an audio signal, comprising:

converting the audio signal from a continuous domain to a frequency domain and obtaining sub-band short-time spectra for a predetermined number of sub-bands of the audio signal;

delaying at least one of the sub-band short-time spectra to obtain a predetermined number of time-delayed sub-band short-time spectra for at least one of the predetermined number of sub-bands; and filtering the sub-band short-time spectrum and the time-delayed sub-band shorttime spectra to obtain a refined sub-band short-time spectrum for the at least one of the predetermined number of sub-bands.

2. The method of claim 1, where converting comprises:

windowing the audio signal to a windowed signal; and discrete Fourier transforming the windowed signal to the sub-band short-time spectra.

3. The method of claim 2, where windowing comprises a Hann window function, a Hamming window function, or a Gaussian window function.

4. The method of claim 1, where filtering comprises selecting a portion of the sub-band short-time spectrum and time-delayed sub-band short-time spectra through a finite impulse response.

5. The method of claim 1, where filtering comprises multiplying filtering coefficients of a refinement matrix with the sub-band short-time spectrum and the time delayed sub-band short-time spectra.

6. A method of processing an audio signal, comprising:

converting the audio signal from a continuous domain to a frequency domain and obtaining sub-band short-time spectra for a predetermined number of sub-bands of the audio signal;

delaying at least one of the sub-band short-time spectra to obtain a predetermined number of time-delayed sub-band short-time spectra for at least one of the predetermined number of sub-bands;

selecting neighbored sub-bands of the sub-band short-time spectra;

filtering, for each pair of neighbored sub-bands, the sub-band short-time spectrum and the time-delayed sub-band short-time spectra to obtain a first filtered spectrum and a second filtered spectrum; and adding the first and second filtered spectra to obtain a refined sub-band short-time spectrum for each pair of neighbored sub-bands.

7. The method of claim 6, where filtering for each pair of neighbored sub-bands comprises multiplying filtering coefficients of a refinement matrix with the sub-band short-time spectrum and the time-delayed sub-band short-time spectra.

8. The method of claim 6, where converting comprises:

windowing the audio signal to a windowed signal; and discrete Fourier transforming the windowed signal to the sub-band short-time spectra.

9. The method of claim 8, where windowing comprises a Hann window function, a Hamming window function, or a Gaussian window function.

10. The method of claim 6, where filtering for each pair of neighbored sub-bands comprises selecting a portion of the sub-band short-time spectrum and time-delayed subband short-time spectra through a finite impulse response.

11. A method of processing an audio signal, comprising:

determining a degree of stationarity of the audio signal;

filtering the audio signal to obtain filtered sub-band short-time spectra, if the degree of stationarity is below a predetermined threshold;

if the degree of stationarity is equal to or greater than the predetermined threshold:

converting the audio signal from a continuous domain to a frequency domain and obtaining sub-band short-time spectra for a predetermined number of subbands of the audio signal;

delaying at least one of the sub-band short-time spectra to obtain a predetermined number of time-delayed sub-band short-time spectra for at least one of the predetermined number of sub-bands;

filtering the sub-band short-time spectrum and the time-delayed sub-band short-time spectra to obtain a refined sub-band short-time spectrum for the at least one of the predetermined number of sub-bands; and filtering the refined sub-band short-time spectrum to obtain the filtered sub-band short-time spectra;

converting the filtered sub-band short-time spectra from the frequency domain to the continuous domain and obtaining an intermediate audio signal; and synthesizing the intermediate audio signal to obtain an output audio signal.

12. The method of claim 11, where the output audio signal comprises a noise reduced signal or an echo reduced signal.

13. The method of claim 11, where converting the filtered sub-band short-time spectra comprises inverse Fourier transforming the filtered sub-band short-time spectra to the intermediate audio signal.

14. The method of claim 11, where converting the audio signal comprises:

windowing the audio signal to a windowed signal; and discrete Fourier transforming the windowed signal to the sub-band short-time spectra.

15. The method of claim 11, where filtering the sub-band short-time spectrum and the time-delayed sub-band short-time spectra comprises selecting a portion of the sub-band short-time spectrum and time-delayed sub-band short-time spectra through a finite impulse response.

16. A method of processing an audio signal, comprising:

converting the audio signal from a continuous domain to a frequency domain and obtaining sub-band short-time spectra for a predetermined number of sub-bands of the audio signal;

delaying at least one of the sub-band short-time spectra to obtain a predetermined number of time-delayed sub-band short-time spectra for at least one of the predetermined number of sub-bands;

filtering the sub-band short-time spectrum and the time-delayed sub-band shorttime spectra to obtain a refined sub-band short-time spectrum for the at least one of the predetermined number of sub-bands;

determining a short-time spectrogram of the refined sub-band short-time spectrum; and estimating a pitch of the audio signal, based on the short-time spectrogram.

17. A system for processing an audio signal comprising:

transformation logic comprising a processor that converts the audio signal from a continuous domain to a frequency domain and generates sub-band short-time spectra for a predetermined number of sub-bands of the audio signal;

delay logic that time shifts at least one of the sub-band short-time spectra to obtain a predetermined number of time-delayed sub-band short-time spectra for at least one of the predetermined number of sub-bands; and refinement logic that filters the sub-band short-time spectrum and the time delayed sub-band short-time spectra to obtain a refined sub-band short-time spectrum for the at least one of the predetermined number of sub-bands.

18. The system of claim 17, where the transformation logic comprises:

windowing logic that selects portions of the audio signal to a windowed signal; and conversion logic that discrete Fourier transforms the windowed signal to the subband short-time spectra.

19. The system of claim 18, where the windowing logic comprises a Hann window function, a Hamming window function, or a Gaussian window function.

20. The system of claim 17, where the refinement logic comprises a finite impulse response filter.

21. The system of claim 17, where the refinement logic comprises a first multiplication logic that multiplies filtering coefficients of a refinement matrix with the sub-band short-time spectrum and the time-delayed sub-band short-time spectra.

22. The system of claim 17, further comprising:

interpolation logic that filters the sub-band short-time spectrum and the time delayed sub-band short-time spectra for each pair of selected neighbored sub-bands to obtain a first filtered spectrum and a second filtered spectrum; and an adder that sums the first and second filtered spectra to obtain an additional sub-band short-time spectrum for each pair of the selected neighbored sub-bands.

23. The system of claim 22, where the interpolation logic comprises a second multiplication circuit that multiplies filtering coefficients of a refinement matrix with the sub-band short-time spectrum and the time-delayed sub-band short-time spectra.

24. The system of claim 17, further comprising:

change analysis logic that determines a degree of stationarity of the audio signal;

sub-threshold stationarity logic that filters the audio signal to obtain filtered subband short-time spectra, if the degree of stationarity is below a predetermined threshold;

super-threshold stationarity logic that filters the refined sub-band short-time spectrum to obtain the filtered sub-band short-time spectra, if the degree of stationarity is equal to or greater than the predetermined threshold; and inverse conversion logic that transforms the filtered sub-band short-time spectra from the frequency domain to the continuous domain to obtain an output audio signal, the output audio signal comprising a noise reduced signal or an echo reduced signal.

25. The system of claim 17, further comprising:

frequency analysis logic that determines a short-time spectrogram of the refined sub-band short-time spectrum; and sound analysis logic that estimates a pitch of the audio signal, based on the short-time spectrogram.

* * * * *